US008556647B2

(12) United States Patent
Carmitchel

(10) Patent No.: US 8,556,647 B2
(45) Date of Patent: Oct. 15, 2013

(54) WALL RECEPTACLE COVER PLATE WITH PLUG LATCH

(75) Inventor: Richard A. Carmitchel, Bonner Springs, KS (US)

(73) Assignee: R C Design & Engineering Incorporated, Bonner Springs, KS (US)

( * ) Notice: Subject to any disclaimer, the term of this patent is extended or adjusted under 35 U.S.C. 154(b) by 0 days.

(21) Appl. No.: 13/316,180

(22) Filed: Dec. 9, 2011

(65) Prior Publication Data

US 2013/0149889 A1 Jun. 13, 2013

(51) Int. Cl.
*H01R 13/627* (2006.01)

(52) U.S. Cl.
USPC ..... 439/354

(58) Field of Classification Search
USPC ..... 439/350–354
See application file for complete search history.

(56) References Cited

U.S. PATENT DOCUMENTS

| | | | | |
|---|---|---|---|---|
| 2,895,119 | A * | 7/1959 | Montgomery, Jr. | 439/354 |
| 3,801,757 | A * | 4/1974 | Carissimi et al. | 200/50.28 |
| 5,049,086 | A * | 9/1991 | Slaven | 439/143 |
| 6,428,333 | B1 * | 8/2002 | Rust | 439/140 |
| 7,078,624 | B1 * | 7/2006 | Stewart | 174/66 |
| 7,744,400 | B2 | 6/2010 | Carmitchel | |
| 7,758,371 | B2 | 7/2010 | Carmitchel | |

* cited by examiner

*Primary Examiner* — Chandrika Prasad
(74) *Attorney, Agent, or Firm* — Erickson Kernell Derusseau & Kleypas, LLC

(57) ABSTRACT

A cover plate for an electrical duplex receptacle has an opening or openings therein as required to permit insertion of male plugs into the respective receiving receptacles. A female receptacle component projects outwardly from the cover plate and receives a stud projecting from the body of an inserted plug to thereby lock the plug against withdrawal that would otherwise occur if sufficient force is applied to pull the plug out of the receptacle and cause a loss of power to connected electrical equipment and resulting interruption in the operation thereof.

6 Claims, 3 Drawing Sheets

WALL RECEPTACLE COVER PLATE WITH PLUG LATCH

This invention relates to a latch for securing an electrical cord to a wall receptacle to prevent inadvertent withdrawal of the cord which may extend to power tools, lights or other appliances during construction or repair of a home, building or other structure, for example, in order to prevent a power failure and the interruption of work.

BACKGROUND OF THE INVENTION

Power tools used in the construction and repair of buildings and other structures are often connected by long electrical cords to an available wall receptacle and, therefore, are subject to power interruptions that are caused by accidental withdrawal of a plug from a remote wall receptacle that may be hidden from view. When this occurs the cable must be traced back to the wall receptacle, which may not be in immediate view from the work site. A delay is thus imposed causing down time and a stoppage in the progress of the job at hand until the power connection is restored. According, it is desirable to lock the plug to the wall receptacle but to do so automatically at the time that the plug is initially inserted, and in a manner such that the plug may be immediately withdrawn from the wall receptacle by one hand for insertion at a different location as the project at hand may demand.

SUMMARY OF THE INVENTION

In an embodiment of the present invention a wall receptacle cord latch is provided on a cover plate for an electrical wall receptacle. A female latch component adjacent the outlet extends outwardly and receives a male latch member projecting from an inserted plug to prevent withdrawal of the plug from the wall receptacle until such time that the latch component is manually released. The outwardly projecting latch component may be integral with the cover plate or provided by a separate component secured to the front face of the existing wall receptacle cover plate. In either configuration the latch component receives a male stud on the plug and thus secures the plug against withdrawal.

Other advantages of this invention will become apparent from the following description taken in connection with the accompanying drawings, wherein is set forth by way of illustration and example, an embodiment of the present invention.

DETAILED DESCRIPTION

Figure 2:
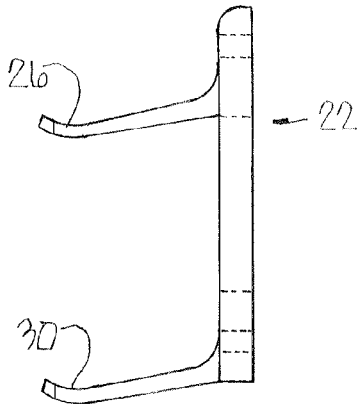
FIG. 2 is a side view of the cord latch of FIG. 1.
Figure 3:
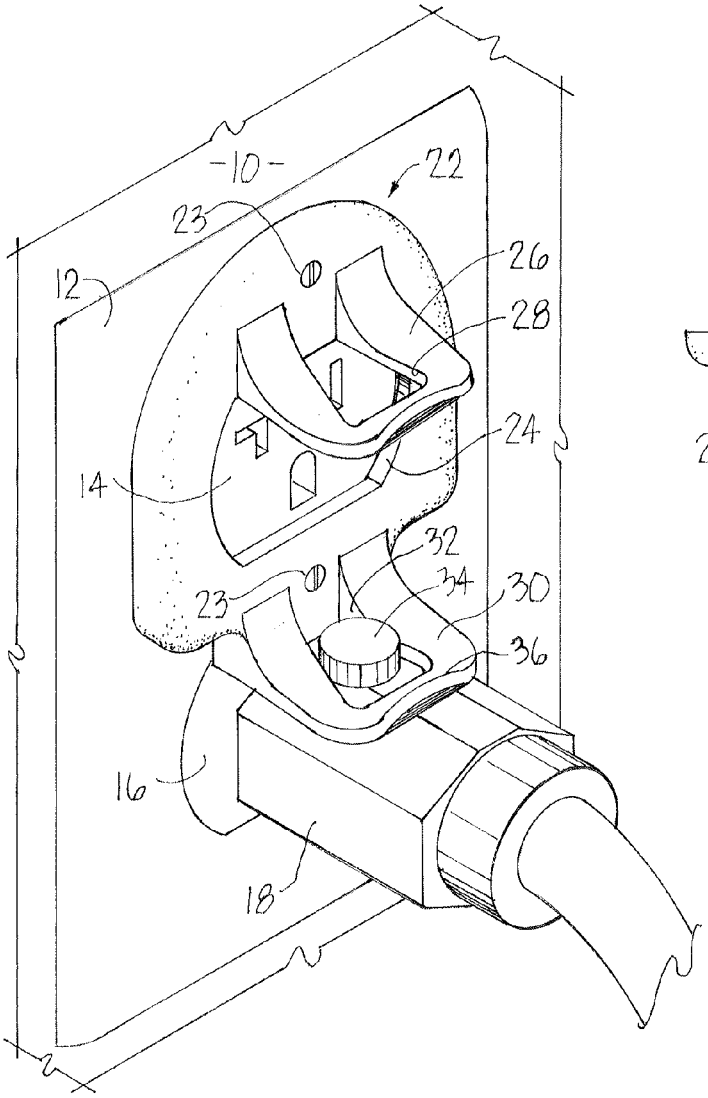
FIG. 3 is a top plan view of the cord latch of FIG. 1.
Figure 4:
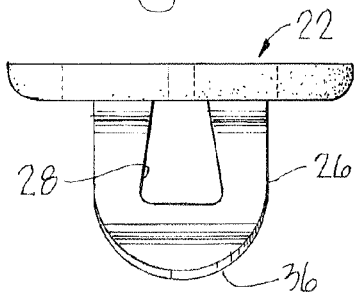
FIG. 4 is a frontal perspective view of the cord latch component of FIG. 1 secured to a cover plate of a duplex receptacle and shown securing a plug inserted into the lower receptacle.

Referring initially to FIGS. 1-4, a conventional duplex receptacle 10 is partially shown in perspective in FIG. 4 having a duplex cover plate 12 thereon through which two receptacles may be accessed, an upper receptacle 14 into which a plug has not been inserted, and a lower receptacle 16 receiving a plug 18 on the end of an electrical cord 20. A receptacle adapter 22 surrounds the opening that provides access to receptacle 14 for insertion of a plug on an electrical cable (not shown in upper receptacle 14) that would extend therefrom, in the same manner as lower plug 18 and cord 20. Accordingly, the receptacle adapter 22 presents an opening 24 registering with the face of the upper receptacle 14 to permit insertion of a plug thereinto.

An outwardly extending, generally U-shaped female latch component 26 is secured and projects generally horizontally outwardly from the adapter 22 and thus presents a latch opening 28. Similarly, a lower female latch component 30 spaced below latch component 26 extends outwardly from the adapter body and is disposed and shaped in a like manner. The lower latch component 30 is shown having its latch opening 32 receiving a retaining pin or stud 34 projecting outwardly from a top side of plug 18 (FIG. 4). As may be appreciated, upon insertion of plug 18 into the lower socket 16, the latch component 30 flexes upon engagement of the stud 34 with an outer lip 36 thereby causing the latch component 30 to flex and then return to the position shown as the stud 34 is inserted fully within the opening 32. This is essentially a snap action that thus secures the plug 18 to prevent withdrawal of the plug from receptacle 16 that could occur if outward force is applied to the cord 20. It may be appreciated that without the cord latch of the present invention, stress on electrical cords can cause this to occur and thus, if not prevented, disconnect a power tool or tools and interrupt the operation of equipment thereby causing downtime and a stoppage in the progress of the work at hand. This is made worse in the frequent instance where the affected power tool is on a long power cord which must be traced back to the interrupted source.

Figure 1:
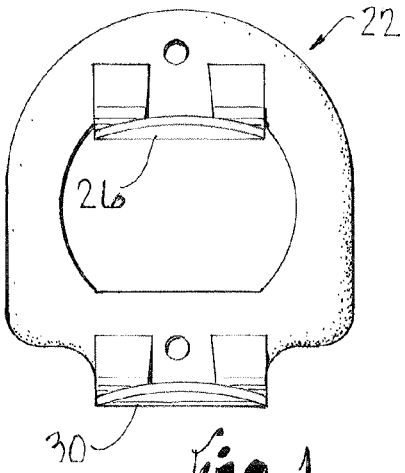
FIG. 1 is a front view of a first embodiment of the cord latch of the present invention having upper and lower latches.

FIGS. 1-3 show the receptacle adapter plate 22 alone (not mounted on cover plate 12 by screws 23). FIGS. 1, 2 and 3 are front, side and top views respectively of the adapter 22.

Figure 5:
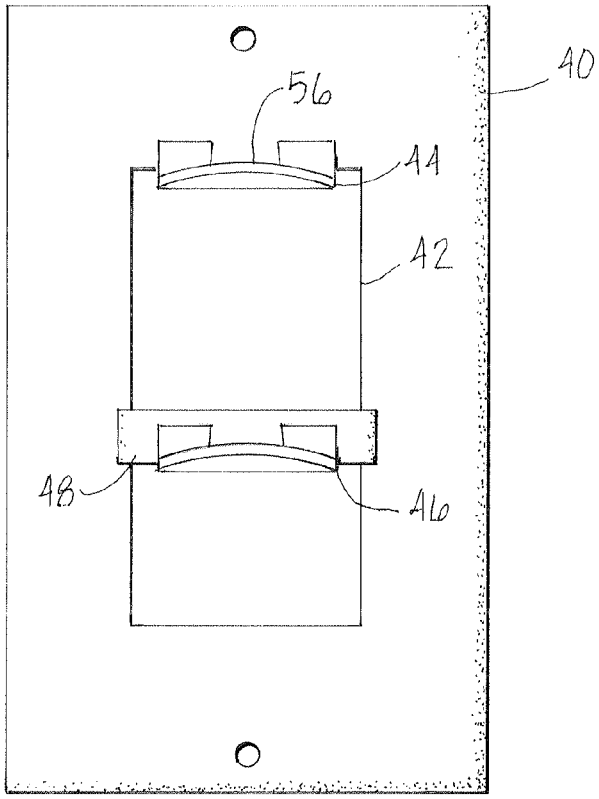
FIG. 5 is a front view of a cover plate for a second embodiment having a ground fault interrupter and provided with spaced, upper and lower cord latches and a transverse bridge associated with the lower latch.
Figure 6:
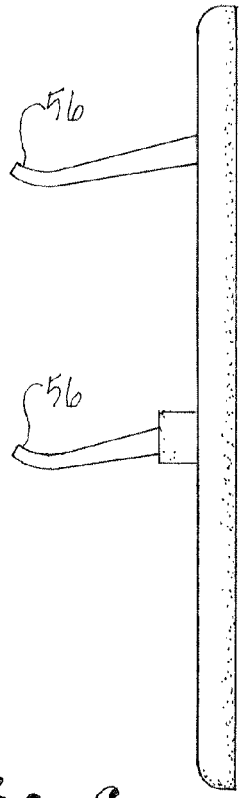
FIG. 6 is a side elevation of the cover plate and upper and lower cord latches of FIG. 5.
Figure 7:
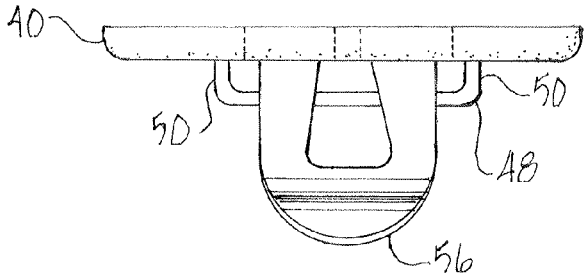
FIG. 7 is a top plan view of the second embodiment of FIG. 5.
Figure 8:
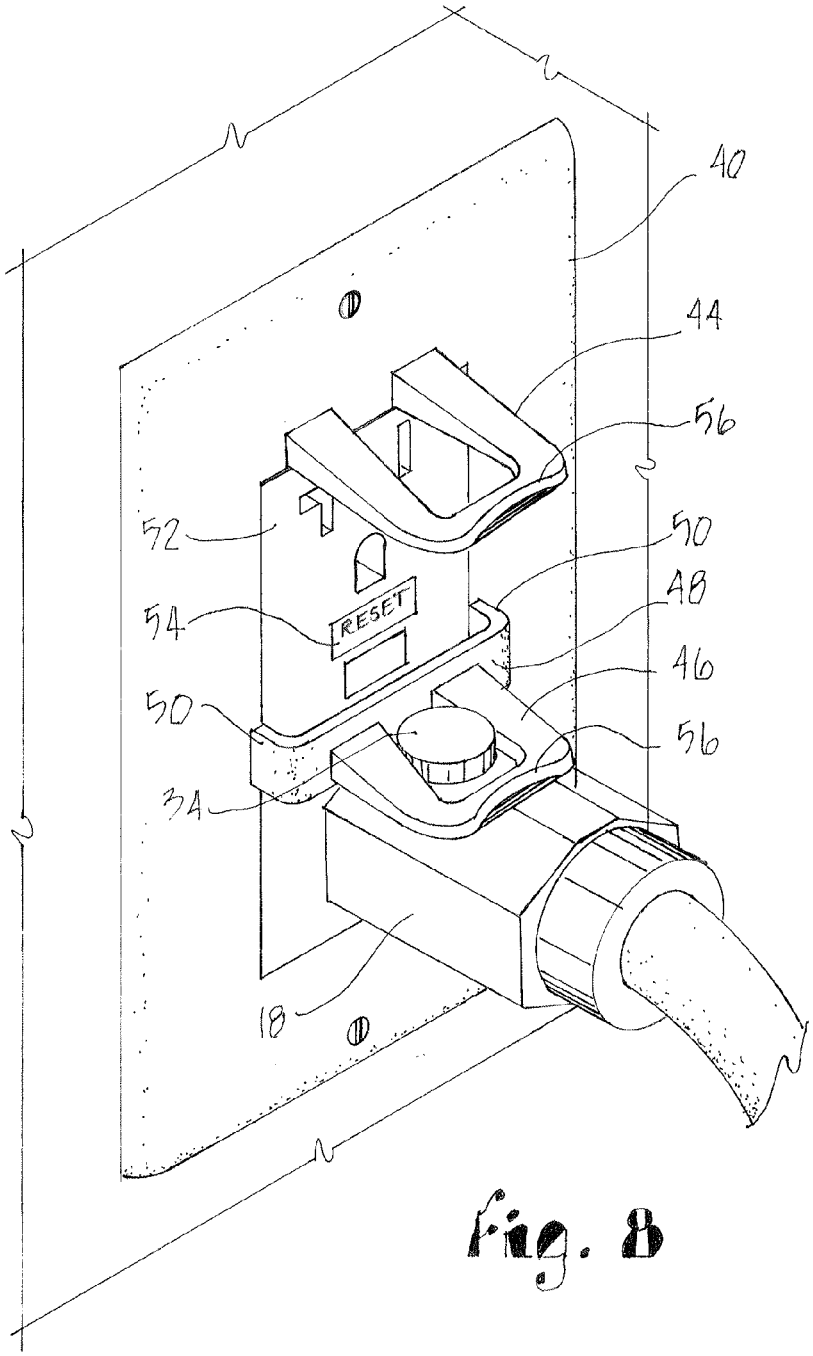
FIG. 8 is a partial, frontal perspective view of a Ground Fault Interrupter receptacle showing a cover plate thereon having integral, outwardly extending latches for upper and lower plugs.

A second embodiment of the present invention is shown in FIGS. 5-8 wherein FIG. 5 is a frontal view of a cover plate 40 having an elongated, rectangular opening 42 therethrough, a female latch component 44 being secured to plate 40 and projecting outwardly therefrom at the upper end of opening 42 for the purpose of preventing withdrawal of an inserted plug (not shown) in the same manner as female latch component 26 in the embodiment of FIG. 4. The lower latch component 46 spaced therebelow, however, is mounted on a transverse bridge 48 which spans the width of opening 42 as is illustrated in FIG. 5. The latch component 46 projects to the front from bridge 48 (see FIG. 8) and receives the stud 34 on plug 18 (FIG. 8). The bridge 48 has inwardly turned ends 50 to space the bridge 48 from the upper receptacle 52 to permit access to a RESET button 54 in socket 52.

In view of the foregoing, it may be appreciated that in either embodiment the plug 18 is secured against inadvertent withdrawal, and in the embodiment of FIG. 8 the configuration provided by the outwardly spaced bridge 48 of cover plate 40 permits access to the RESET button 54. Also, insertion of plug 18 into engagement with either of the latch components 26, 30 or 44, 46 is facilitated by an upstanding, curved outer lip 36 (FIG. 1-4) or 56 (FIGS. 5-8) which flexes the respective female latch component upwardly during insertion to provide a snap lock. Also, the lip 36 or 56 facilitates withdrawal of the plug 18 by upward force applied by the user's thumbnail as the plug is grasped.

It should be understood that while certain forms of this invention have been illustrated and described, it is not limited thereto except insofar as such limitations are included in the following claims.

Having thus described the invention, what is claimed as new and desired to be secured by Letters Patent is:

1. In combination with an electrical socket mounted in an electrical box, a cover plate secured to the electrical socket and having an opening permitting access to the electrical socket, and a plug secured to an end of an electrical cord and having prongs for insertion in the electrical socket, a plug latch comprising:

a generally U-shaped, resilient female latch component secured to the cover plate, projecting outwardly from the cover plate, and having a latch opening and an outer lip, said female latch component having a first position and a flexed position, and a fixed stud projecting outwardly from a side of the plug, said latch opening of said female latch component configured to receive said stud, wherein said female latch component flexes upon engagement of said stud with said outer lip when inserting the plug into the electrical socket thereby moving said female latch component to said flexed position;

wherein said female latch component returns to said first position and said latch opening engages said stud when the plug is inserted into the electrical socket thereby locking the plug in the electrical socket to prevent withdrawal of the plug from the electrical socket.

2. The plug latch of claim 1 wherein said female latch component is integral with the cover plate.

3. The plug latch of claim 1 wherein said outer lip of said female latch component is disposed for engagement by a thumb of a user to move said female latch component to said flexed position to facilitate withdrawal of the plug from the electrical socket.

4. In combination with first and second electrical sockets mounted in an electrical box, a cover plate secured to the electrical sockets and having openings permitting access to each of the electrical sockets, and a plug secured to an end of an electrical cord and having prongs for insertion in the electrical socket, a plug latch comprising:

a first generally U-shaped, resilient female latch component secured to the cover plate, projecting outwardly from the cover plate above said first electrical socket, and having a latch opening and an outer lip, said first female latch component having a first position and a flexed position, a second generally U-shaped, resilient female latch component secured to the cover plate, projecting outwardly from the cover plate above said second electrical socket, and having a latch opening and an outer lip, said second female latch component having a first position and a flexed position, and a fixed stud projecting outwardly from a side of the plug, said first female latch component latch opening configured to receive said stud, said second female latch component latch opening configured to receive said stud, wherein said first female latch component flexes upon engagement of said stud with said outer lip of said first female latch component when inserting the plug into the first electrical socket thereby moving said first female latch component to said first female latch component flexed position, wherein said first female latch component returns to said first female latch component first position and said first female latch component latch opening engages said stud when the plug is inserted into the first electrical socket thereby locking the plug in the first electrical socket to prevent withdrawal of the plug from the first electrical socket, wherein said second female latch component flexes upon engagement of said stud with said outer lip of said second female latch component when inserting the plug into the second electrical socket thereby moving said second female latch component to said second female latch component flexed position, and wherein said second female latch component returns to said second female latch component first position and said second female latch component latch opening engages said stud when the plug is inserted into the second electrical socket thereby locking the plug in the second electrical socket to prevent withdrawal of the plug from the second electrical socket.

5. The plug latch of claim 4 wherein said first and second female latch components are integral with the cover plate.

6. The plug latch of claim 4 wherein each said outer lip of said first and second female latch components is disposed for engagement by a thumb of a user to move each said first and second female latch components to said flexed position to facilitate withdrawal of the plug from the first or second electrical socket.

* * * * *